US011311081B2

(12) United States Patent
Millward

(10) Patent No.: US 11,311,081 B2
(45) Date of Patent: Apr. 26, 2022

(54) WEBBING STRAP TRAP

(71) Applicant: Illinois Tool Works Inc., Glenview, IL (US)

(72) Inventor: Eric Millward, Evanston, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 17/127,466

(22) Filed: Dec. 18, 2020

(65) Prior Publication Data

US 2021/0212412 A1 Jul. 15, 2021

Related U.S. Application Data

(60) Provisional application No. 62/961,322, filed on Jan. 15, 2020.

(51) Int. Cl.
*A44B 11/04* (2006.01)

(52) U.S. Cl.
CPC ..... *A44B 11/04* (2013.01)

(58) Field of Classification Search
CPC ..... A44B 11/04
See application file for complete search history.

(56) References Cited

U.S. PATENT DOCUMENTS 1,853,889 A * 4/1932 Alterson ..... A44B 11/04 24/312
1,999,168 A * 4/1935 Erb ..... A44B 11/04 24/321
2,007,436 A * 7/1935 Troendly ..... A44B 11/04 24/321
2,011,634 A * 8/1935 Hirsh ..... A44B 11/04 24/200
2,099,199 A * 11/1937 Devendor ..... A44B 11/04 24/198
2,133,153 A * 10/1938 Shaulson ..... A44B 11/04 24/198
2,212,862 A * 8/1940 Hirsh ..... A44B 11/04 24/198
2,224,773 A * 12/1940 Shaulson ..... A44B 11/28 24/200
2,229,003 A * 1/1941 Fly ..... A44B 11/065 242/388.2
2,260,060 A * 10/1941 Shaulson ..... A44B 11/04 24/200
2,276,595 A * 3/1942 Shaulson ..... A44B 11/04 24/200

(Continued)

FOREIGN PATENT DOCUMENTS

FR 2626151 A * 7/1989
JP 5453563 B1 * 3/2014
KR 2016150268 A * 12/2016

OTHER PUBLICATIONS

Pictures of known webbing straps prior to Jan. 15, 2020; 1 page.

*Primary Examiner* — Jason W San
(74) *Attorney, Agent, or Firm* — Neal, Gerber & Eisenberg LLP

(57) ABSTRACT

A webbing strap trap including a connecting bar, a first keeper bar connected to the connecting bar, a second keeper bar connected to the connecting bar, a first retaining arm connected to the connecting bar, and a second retaining arm connected to the connecting bar.

18 Claims, 10 Drawing Sheets

(56) References Cited

U.S. PATENT DOCUMENTS 2,278,153 A * 3/1942 Shaulson ..... A44B 11/04 24/200
2,285,714 A * 6/1942 Hirsh ..... A44B 11/04 24/199
2,293,562 A * 8/1942 Rosenthal ..... A44B 11/04 24/200
2,317,571 A * 4/1943 White ..... A44B 11/04 24/171
2,317,679 A * 4/1943 Elwell ..... A44B 11/04 24/321
2,407,466 A * 9/1946 Alberts ..... A44B 11/04 24/200
2,473,209 A * 6/1949 Lombardi ..... A44B 11/04 24/321
2,565,629 A * 8/1951 Reinberger ..... A44B 11/04 24/200
2,569,933 A * 10/1951 Johnson ..... A44B 11/04 24/197
2,613,420 A * 10/1952 Brown ..... A44B 11/04 24/200
2,981,994 A * 5/1961 White ..... A44B 11/04 24/200
3,064,271 A * 11/1962 Kuber ..... A44B 11/003 2/311
3,075,268 A * 1/1963 Schwartz ..... A41F 15/002 24/200
3,161,931 A * 12/1964 Zif ..... A41F 1/006 24/200
3,956,805 A 5/1976 Stroh
4,627,132 A * 12/1986 Markham ..... A41F 9/007 24/163 K
4,893,382 A * 1/1990 Lindblad ..... A44B 11/04 24/200
D329,537 S * 9/1992 McLean ..... D2/639
5,265,910 A * 11/1993 Barr ..... B60R 22/024 24/197
D356,658 S * 3/1995 Bernart ..... D2/624
5,608,918 A 3/1997 Salvaggio
5,733,004 A * 3/1998 Celestina-Krevh ..... B60N 2/26 24/197
D452,361 S * 12/2001 Patrizi ..... D2/624
D488,912 S * 4/2004 Berger ..... D2/627
7,278,900 B1 * 10/2007 Ostaseski ..... A41F 15/02 450/86
D688,977 S * 9/2013 Mohr ..... D11/218
8,764,360 B2 * 7/2014 Vick ..... A44B 11/04 410/97
D717,145 S * 11/2014 Tang ..... D8/34
D750,471 S * 3/2016 Achenbach ..... D8/356
9,560,909 B2 2/2017 Krpan
D854,815 S * 7/2019 Jensen ..... D3/215
10,548,373 B2 * 2/2020 Sorensen ..... A44B 11/065
10,561,205 B2 * 2/2020 Fildan ..... A41F 1/00
2014/0140784 A1 * 5/2014 Vick ..... A44B 11/04 410/97
2014/0304898 A1 * 10/2014 Bachtold ..... A44B 11/04 2/336
2016/0150873 A1 * 6/2016 Krpan ..... A44B 11/006 24/3.12
2017/0273378 A1 * 9/2017 Parker-Austin ..... A41F 15/002
2018/0055153 A1 * 3/2018 Ressler ..... A44B 11/04
2018/0255881 A1 * 9/2018 Sorensen ..... A44B 11/065
2018/0310653 A1 * 11/2018 Martinez ..... A44B 11/005
2018/0317611 A1 * 11/2018 Rittenhouse ..... A44B 11/04
2019/0313746 A1 * 10/2019 Hetrich ..... A44B 11/28
2020/0107648 A1 * 4/2020 Massale ..... A47C 31/11
2020/0138150 A1 * 5/2020 Dollman ..... A45C 13/1092
2020/0154833 A1 * 5/2020 Bergman ..... A44B 11/04
2020/0156927 A1 * 5/2020 Bates ..... B68C 1/14

* cited by examiner

WEBBING STRAP TRAP

PRIORITY

This application claims priority to and the benefit of U.S. Provisional Patent Application Ser. No. 62/961,322, filed Jan. 15, 2020, the entire contents of which is incorporated herein by reference.

BACKGROUND

Backpacks, lifejackets, helmets, and various other products often include one or more webbing straps with one or more adjusting devices to accommodate various uses of the products and different size users of the products. Such webbing straps often have excess end sections when in use. These excess end sections of the webbing straps are often left to hang from the products when the products are in use. If not secured in a suitable manner, these excess end sections of webbing straps can flap around in an undesired manner as the products are being used and can catch on foreign objects in an undesired manner.

Accordingly, there is a continuing need for devices that provide a solution for controlling such excess end sections of webbing straps and that can be used to prevent such excess end sections of webbing straps from flapping around as a product is being used and from catching on foreign objects.

BRIEF SUMMARY

Various embodiments of the present disclosure provide a webbing strap trap that is formed from a single material and easily attachable to multiple sections of a webbing strap of a product (such as but not limited to a backpack, a life jacket, or a helmet). The webbing strap trap is configured to control and limit movement of an excess end section of the webbing strap to prevent such excess end section from flapping around and from catching on foreign objects.

In various embodiments of the present disclosure, the webbing strap trap includes a connecting bar, a first keeper bar connected to the connecting bar, a second keeper bar connected to the connecting bar, a first retaining arm connected to the connecting bar, and a second retaining arm connected to the connecting bar. The first keeper bar and the second retaining arm define a first strap receiving gap, and the second keeper bar and the first retaining arm define a second strap receiving gap.

In various embodiments of the present disclosure, the webbing strap trap includes a connecting bar, a first keeper bar connected to the connecting bar, wherein the first keeper bar includes a first strap engagement hand spaced apart a first distance from the connecting bar, and a second keeper bar connected to the connecting bar, wherein the second keeper bar includes a second strap engagement hand spaced apart a second distance from the connecting bar. The webbing strap trap also includes a first retaining arm connected to the connecting bar, wherein the first retaining arm includes a third strap engagement hand spaced apart a third distance from the connecting bar, and a second retaining arm connected to the connecting bar, wherein the second retaining arm including a fourth strap engagement hand spaced apart a fourth distance from the connecting bar.

In various embodiments of the present disclosure, the webbing strap trap includes a connecting bar, a first keeper bar, a second keeper bar, a first retaining arm, and a second retaining arm. The first keeper bar is connected to the connecting bar. The first keeper bar includes a first strap engagement shoulder connected to and extending transversely outwardly from a first end section of the connecting bar, and a first strap engagement hand connected to and extending transversely inwardly from the first strap engagement shoulder. The second keeper bar is connected to the connecting bar. The second keeper bar includes a second strap engagement shoulder connected to and extending transversely outwardly from a second end section of the connecting bar, and a second strap engagement hand connected to and extending transversely inwardly from the second strap engagement shoulder. The first retaining arm is connected to the connecting bar. The first retaining arm includes a third strap engagement shoulder connected to and extending transversely outwardly from the first end of the connecting bar, and a third strap engagement hand connected to and extending transversely inwardly from the third strap engagement shoulder. The second retaining arm is connected to the connecting bar. The second retaining arm includes a fourth strap engagement shoulder connected to and extending transversely outwardly from the second end section of the connecting bar, and a fourth strap engagement hand connected to and extending transversely inwardly from the fourth strap engagement shoulder.

Other objects, features, and advantages of the present disclosure will be apparent from the following detailed disclosure and accompanying drawings.

DETAILED DESCRIPTION

Figure 1:
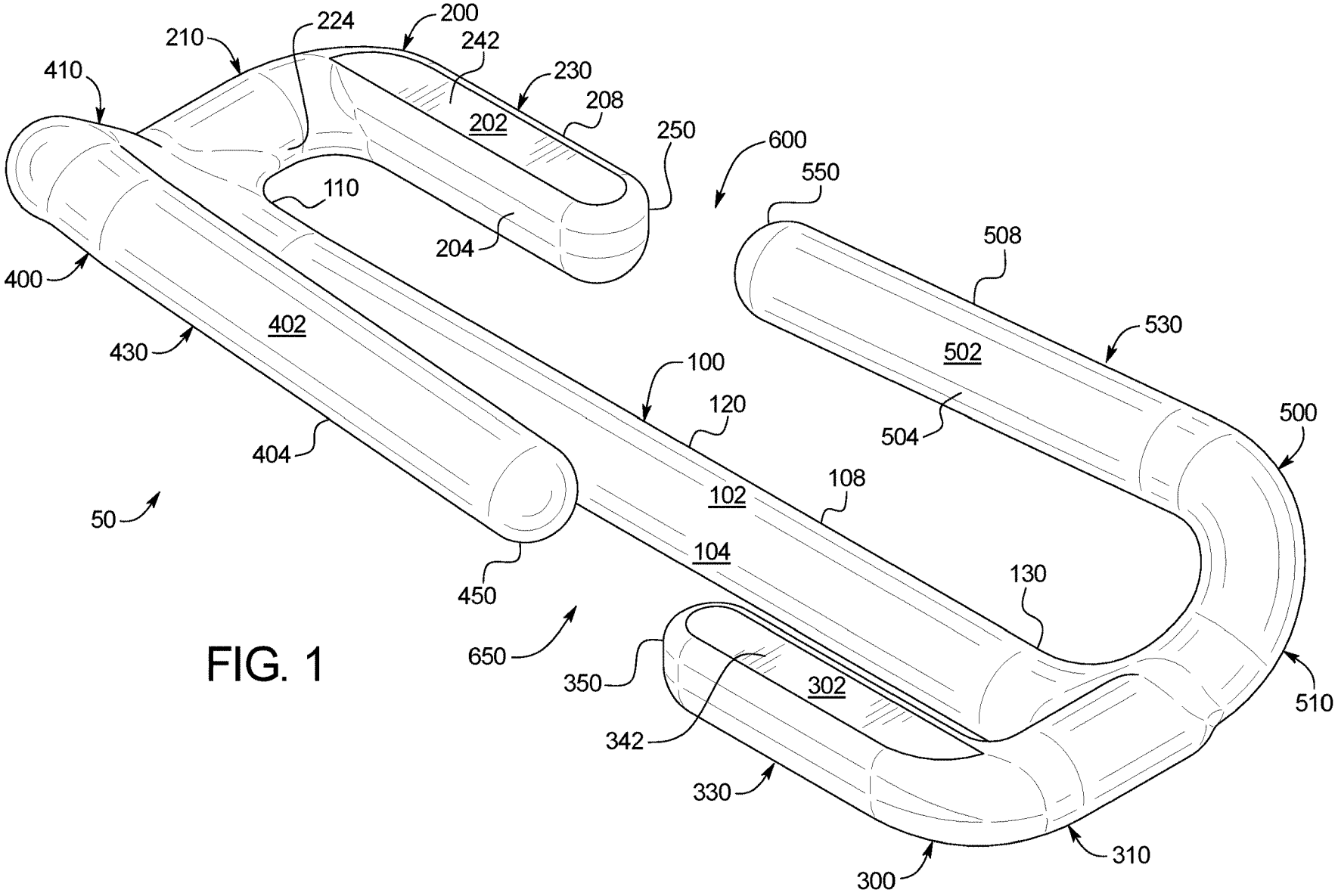
FIG. 1 is a perspective view of a webbing strap trap of one example embodiment of the present disclosure.
Figure 2:
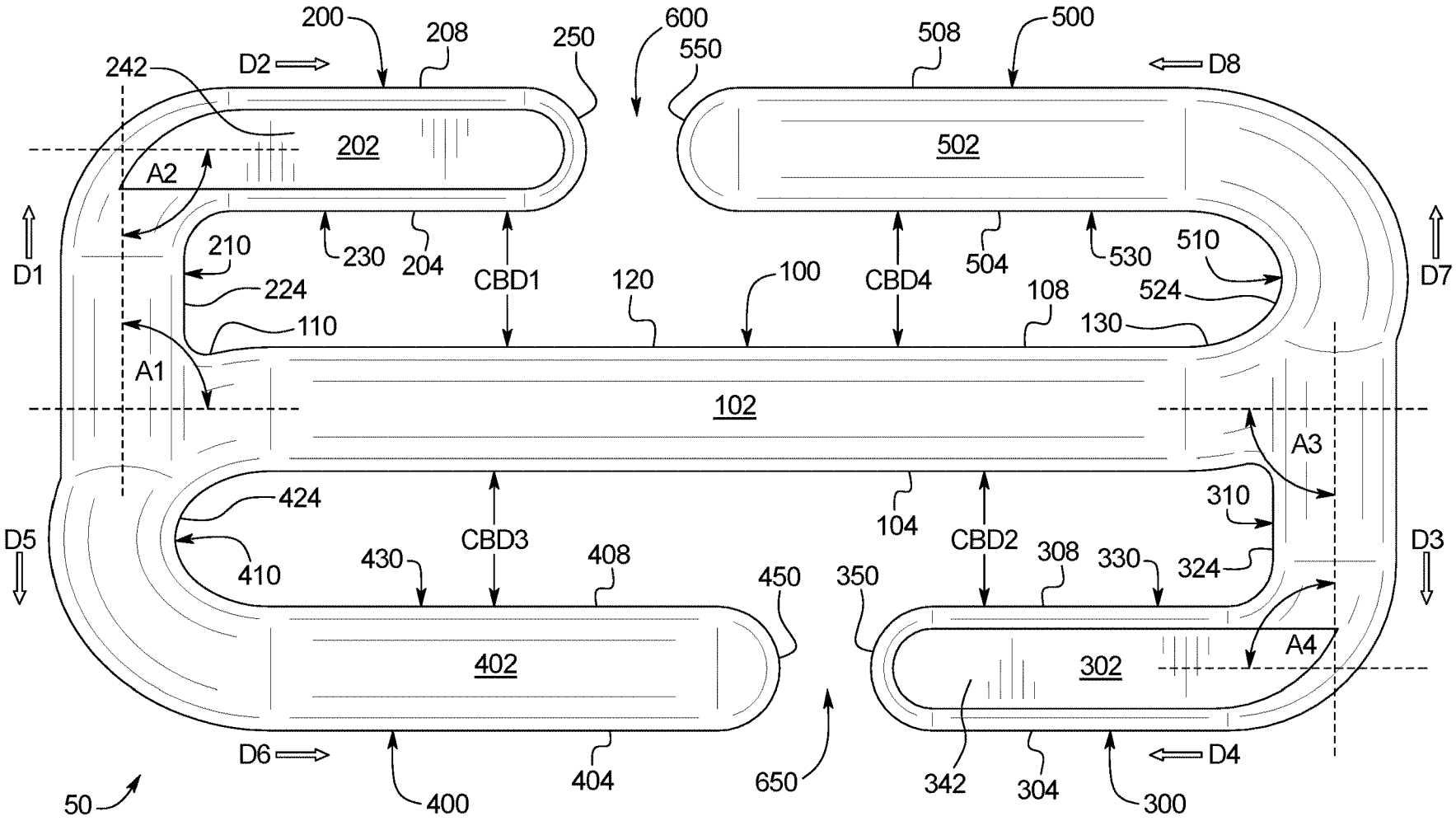
FIG. 2 is a front view of the webbing strap trap of FIG. 1.
Figure 3:
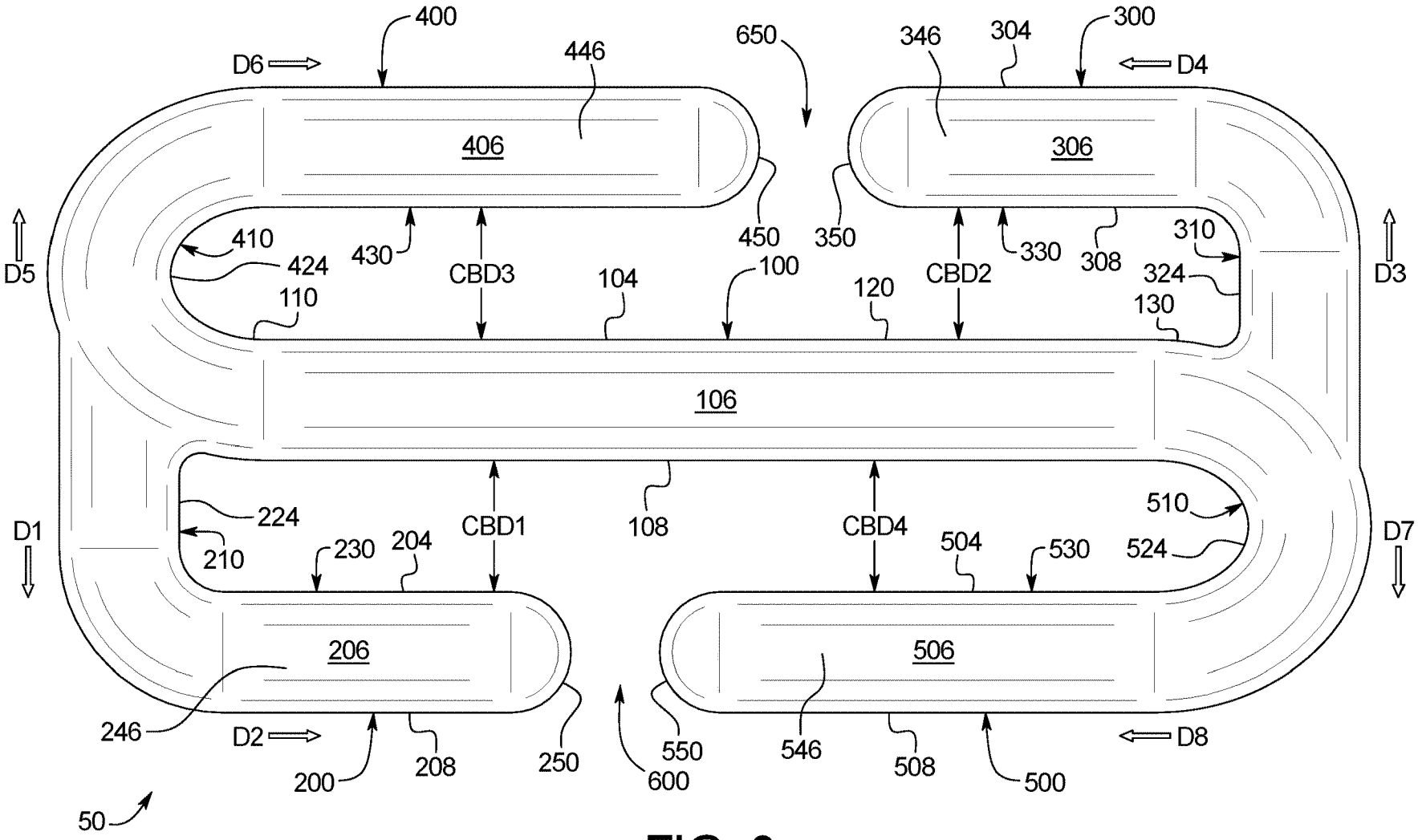
FIG. 3 is a rear view of the webbing strap trap of FIG. 1.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

Turing now to the drawings, FIGS. 1 to 13 illustrate a webbing strap trap of one example embodiment of the present disclosure that is generally indicated by numeral 50, and sometimes referred to herein as the "strap trap" or as the "trap" for brevity. The strap trap 50 is configured to be attached to multiple sections of a webbing strap (including an excess end section) to prevent the excess end section from hanging from a product to which the webbing strap is attached such as shown in FIGS. 8, 9, 10, and 11.

More specifically, this illustrated example webbing strap trap 50 includes: (1) a connecting bar 100; (2) a first keeper bar 200 connected to and extending from the connecting bar 100; (3) a second keeper bar 300 connected to and extending from the connecting bar 100; (4) a first retaining arm 400 connected to and extending from the connecting bar 100; and (5) a second retaining arm 500 connected to and extending from the connecting bar 100.

The webbing strap trap 50, and particularly the connecting bar 100, the first keeper bar 200, the second keeper bar 300, the first retaining arm 400, and the second retaining arm 500 are integrally connected and specifically monolithically suitably formed (such as via injection molding) in this illustrated example embodiment. The trap 50 is formed from a suitable plastic in this illustrated example embodiment. In one example embodiment, the trap 50 is formed from a Polyoxymethylene (POM) (that is also known as acetal, polyacetal, and polyformaldehyde). This plastic material is relatively rigid to limit the relative movements of the connecting bar 100, the first keeper bar 200, the second keeper bar 300, the first retaining arm 400, and the second retaining arm 500 to each other, as further described below. It should be appreciated that the webbing strap trap can be formed in other suitable manners and from other suitable materials in accordance with the present disclosure.

Figure 8:
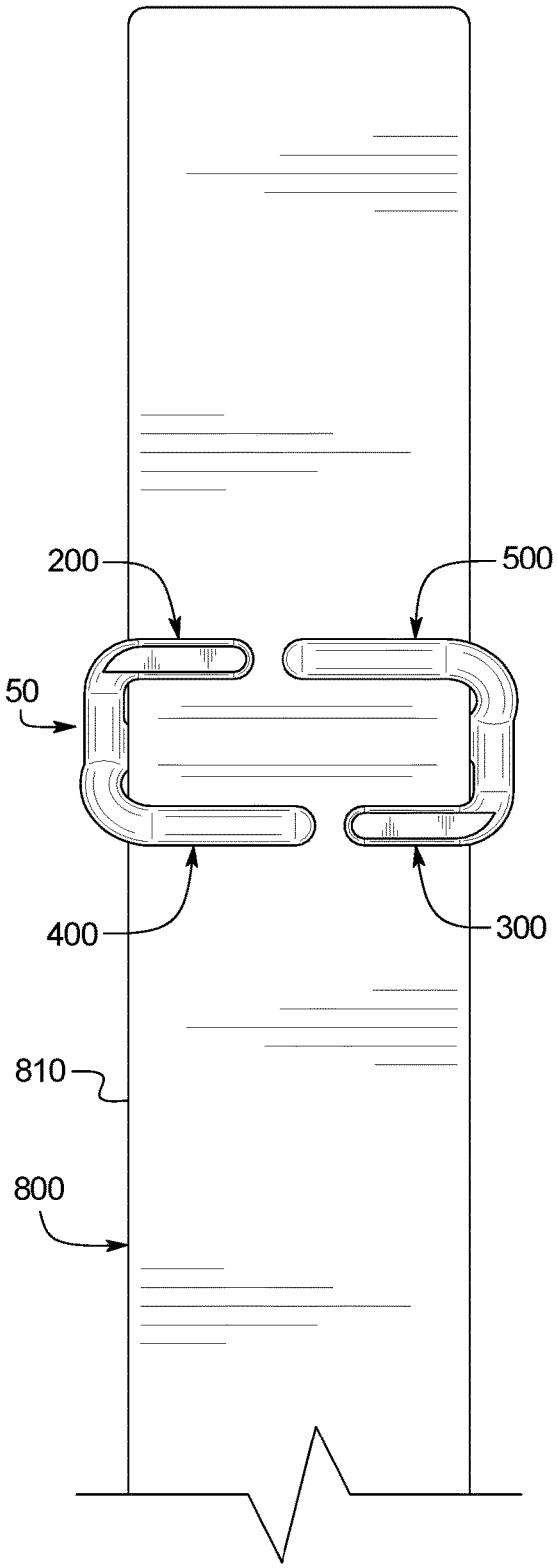
FIG. 8 is a front view of the webbing strap trap of FIG. 1 attached to a first section of a webbing strap (shown in fragmentary).
Figure 9:
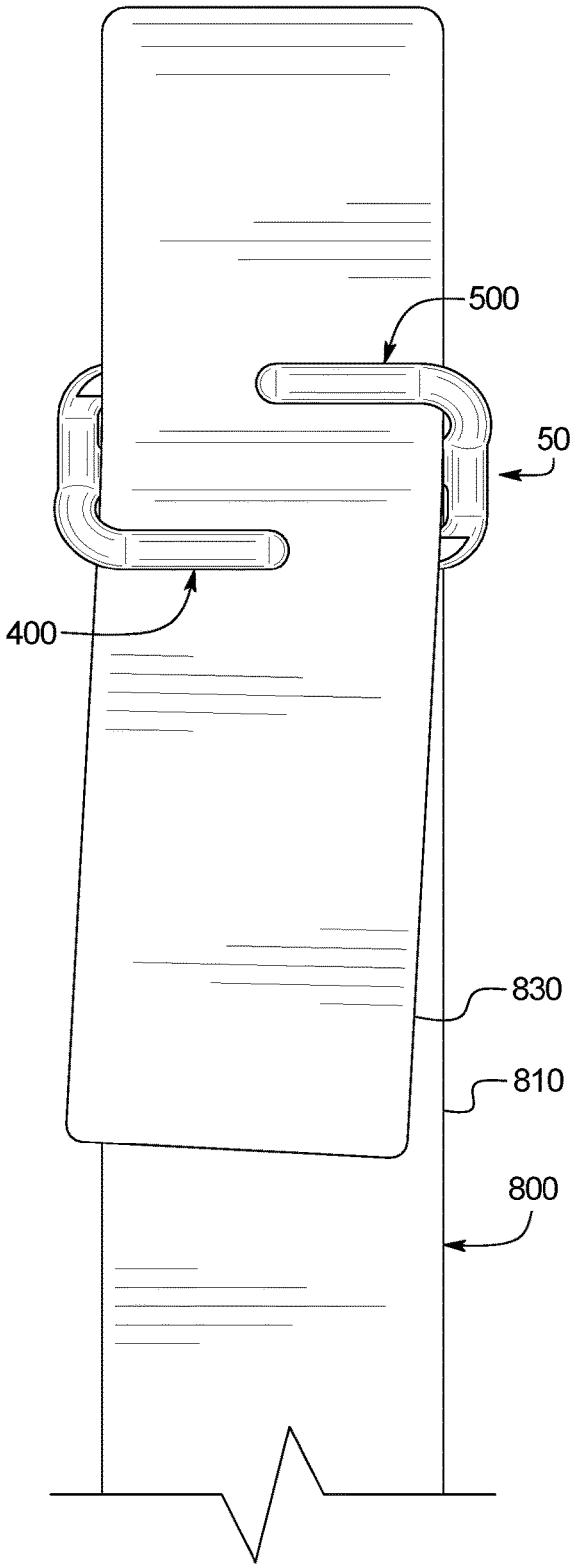
FIG. 9 is a front view of the webbing strap trap of FIG. 1 attached to a first section of a webbing strap (shown in fragmentary) and a second end section of the webbing strap.
Figure 10:
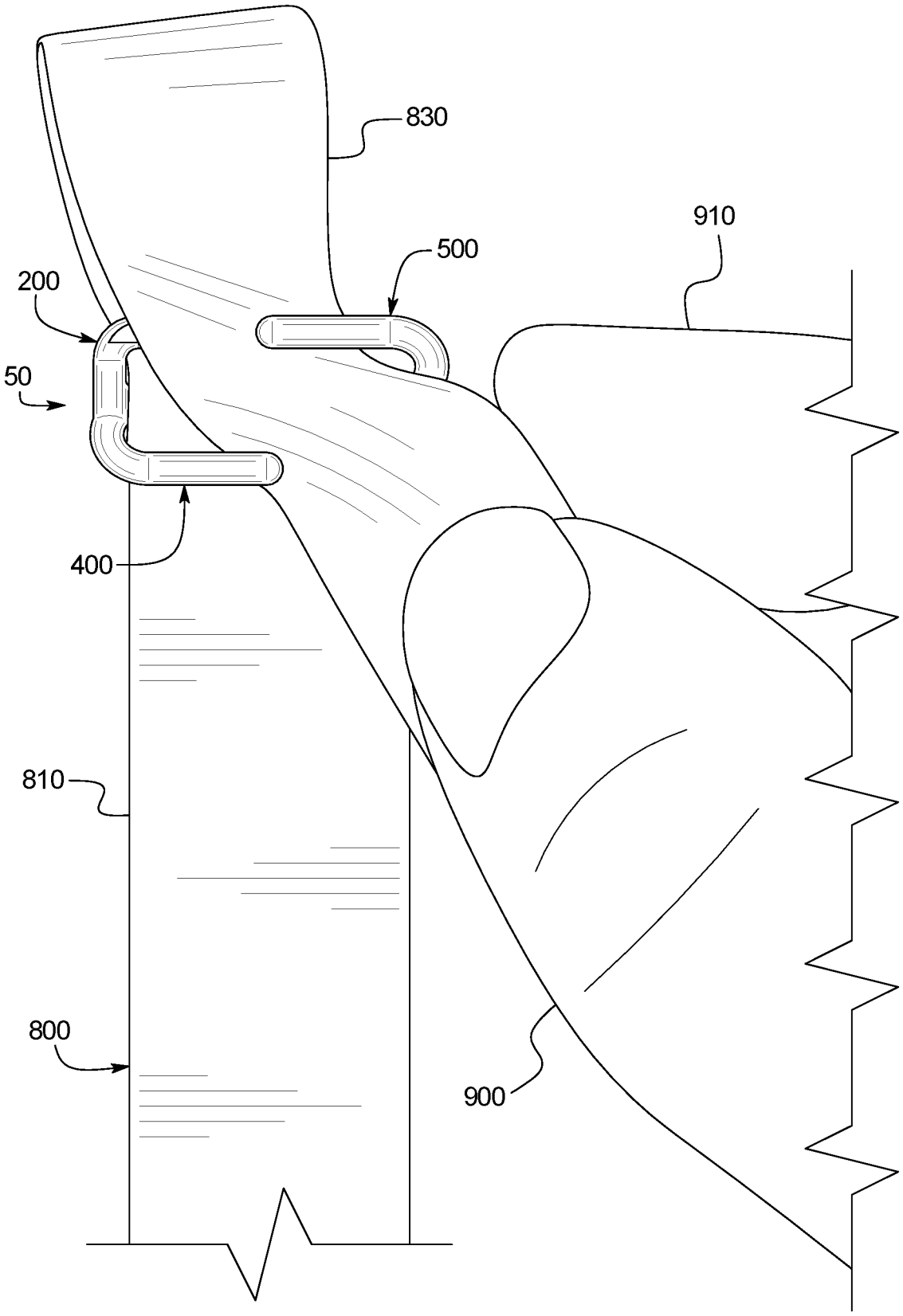
FIG. 10 is a front view of the webbing strap trap of FIG. 1 attached to a first section of a webbing strap (shown in fragmentary) and showing fingers (shown in fragmentary) of a person (not shown) attaching the second end section of the webbing strap to the webbing strap trap.
Figure 11:
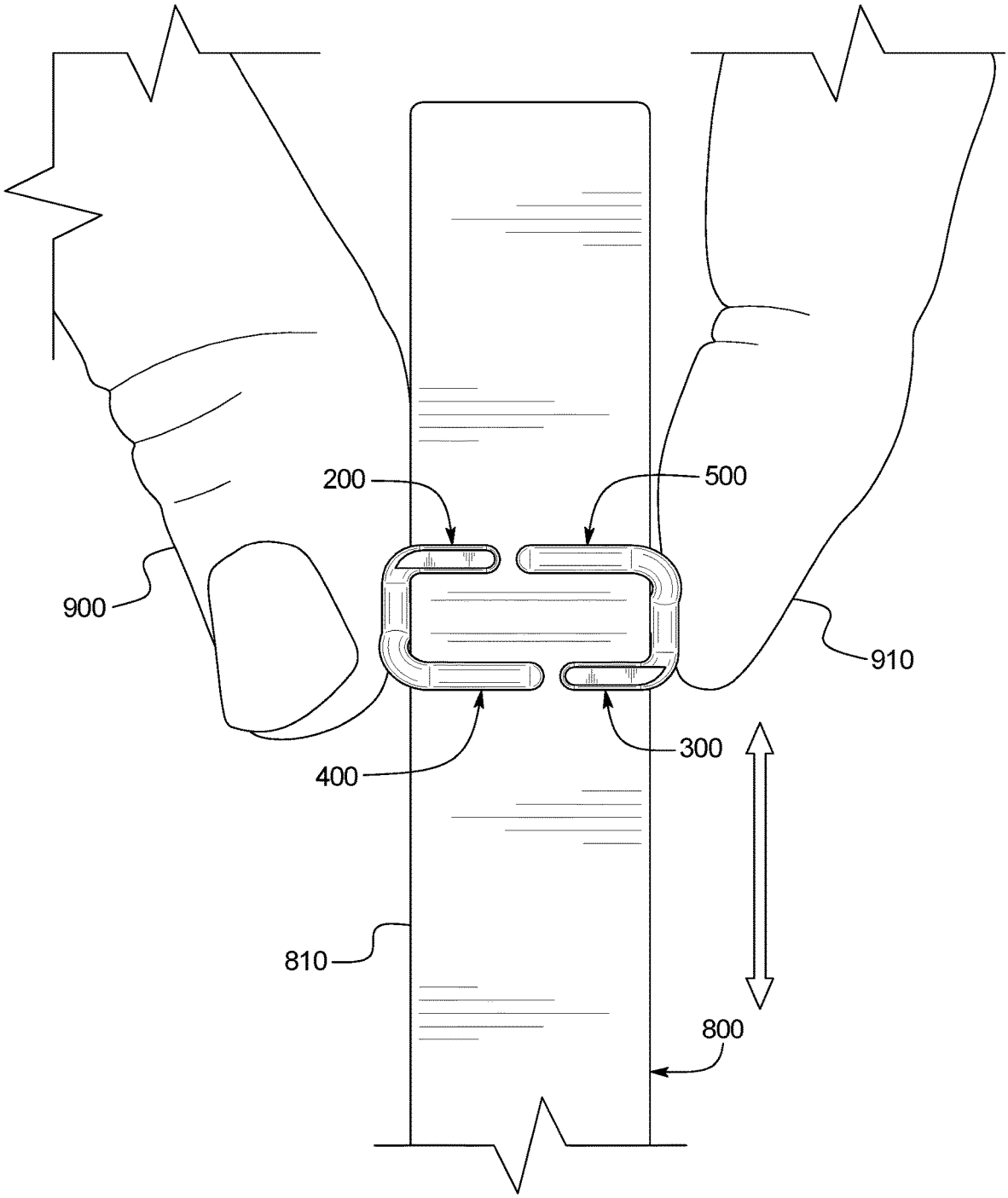
FIG. 11 is a front view of the webbing strap trap of FIG. 1 attached to a first section of a webbing strap (shown in fragmentary) and showing fingers (shown in fragmentary) of a person (not shown) moving the webbing strap trap along the first section of the webbing strap.

The connecting bar 100 generally has a first end section 110, an intermediate section 120, and a second end section 130. The connecting bar 100 (including these sections 110, 120, and 130) is formed from a straight cylindrical solid member having an upper surface 102, a first side surface 104, a lower surface 106, and a second side surface 108. The upper surface 102, the first side surface 104, the lower surface 106, and the second side surface 108 are all curved or convex. In use, the upper surface 102 is configured to engage or be engaged by a rear surface of a first section 810 of a webbing strap 800 such as shown in FIGS. 8, 10, and 11. The connecting bar 100 is configured to engage the rear surface of the first section 810 of the webbing strap 800 to partially attach to and hold the first section 810 of the webbing strap 800 as shown in FIGS. 8, 9, 10, and 11. The connecting bar 100 is also configured enable the strap trap 50 to slide in either direction along the first section 810 of the webbing strap 800 as generally indicated in FIG. 11.

It should be appreciated that while the connecting bar 100 has a generally cylindrical configuration, the connecting bar can have a different shape (including one or more differently configured outer surfaces) in accordance with the present disclosure. It should also be appreciated that the connecting bar can be otherwise suitably configured and sized in accordance with the present disclosure. It should further be appreciated that the connecting bar can be formed from a tubular member instead of a solid member. It should further be appreciated that more than one connecting bars can be employed in the webbing strap trap in accordance with the present disclosure.

The first keeper bar 200 includes a somewhat L-shaped partially cylindrical solid member having an upper surface 202, a first side surface 204, a lower surface 206, and a second side surface 208. More specifically, the first keeper bar 200 includes: (1) a first strap engagement shoulder 210 connected to and extending transversely outwardly in a first direction (D1) from and at a first angle (A1) to the first end section 110 of the connecting bar 100; and (2) a first strap engagement hand 230 connected to and extending transversely inwardly in a second direction (D2) from the first strap engagement shoulder 210, at a second angle (A2) to the first strap engagement shoulder 210, and at a first distance (CBD1) from the connecting bar 100. The first direction (D1) is transverse to the direction (not labeled) of the connecting bar 100. The second direction (D2) is transverse to the first direction (D1). The first angle (A1) is approximately 90 degrees; however, it should be appreciated that this first angle may vary in accordance with the present disclosure. The second angle (A2) is approximately 90 degrees; however, it should be appreciated that this second angle may vary in accordance with the present disclosure. In this example embodiment, the first distance (CBD1) is 3.65 mms; however, it should be appreciated that this distance may vary in accordance with the present disclosure. It should be appreciated that this example size is configured to receive a webbing with a 40 mm width. It should be appreciated that in other example embodiments, the entire webbing strap trap can be larger or smaller and can received larger or smaller width webbings. For example, various example smaller webbing strap traps may have: (1) a CBD1 of 2.28 mms and be configured to receive a webbing having a 25 mm width; (2) a CBD1 of 2.32 mms and be configured to receive a webbing having a 20 mm width; and (3) a CBD1 of 2.40 mms and be configured to receive a webbing having a 16 mm width.

The first strap engagement shoulder 210 includes a first section (not labeled) connected to the first end section 110 of the connecting bar 100, and a second section (not labeled) connected to the first strap engagement hand 230. The first strap engagement shoulder 210 and particularly these first and second sections thereof are formed with suitable lengths, at suitable angles, and with suitable curvatures as best shown in FIGS. 1 to 7 to position the first strap engagement hand 230 relative to the connecting bar 100 (and specifically at the designated angle relative to the connecting bar 100, the designated direction relative to the connecting bar 100, and the designated distance from the connecting bar 100). The first strap engagement shoulder 210 includes an inner surface 224 configured to engage, be engaged by, and/or contain the first side edges of the first section 810 and of the second or end section 830 of the webbing strap 800 as shown in FIGS. 8, 9, 10, and 11.

The first strap engagement hand 230 includes a first section (not labeled) connected to the first strap engagement shoulder 210 and a second section (not labeled) having a rounded free end 250. The second section of the first strap engagement hand 230 includes a portion of the upper surface that is flat. This flat portion 242 of the upper surface is configured to engage or be engaged by the second or end section 830 of the webbing strap 800 as shown in FIGS. 9 and 10. The second section of the first strap engagement hand 230 also includes a rounded lower surface 246 configured to engage, be engaged by, and/or contain the first section 810 of the webbing strap 800 as shown in FIGS. 8, 9, 10, and 11.

It should be appreciated that the first keeper bar can be otherwise suitably configured and sized in accordance with the present disclosure. It should further be appreciated that the first keeper bar can be formed from a tubular member instead of a solid member in accordance with the present disclosure. It should further be appreciated that more than one first keeper bar can be employed in the webbing strap trap in accordance with the present disclosure.

Likewise, the second keeper bar 300 includes a somewhat L-shaped partially cylindrical solid member having an upper surface 302, a first side surface 304, a lower surface 306, and a second side surface 308. More specifically, the second keeper bar 300 includes: (1) a second strap engagement shoulder 310 connected to and extending transversely outwardly in a third direction (D3) from and at a third angle (A3) to the second end section 130 of the connecting bar 100; and (2) a second strap engagement hand 330 connected to and extending transversely inwardly in a fourth direction (D4) from the second strap engagement shoulder 310, at a fourth angle (A4) to the second strap engagement shoulder 310, and at a second distance (CBD2) from the connecting bar 100. The third direction (D2) is transverse to the direction (not labeled) of the connecting bar 100. The fourth direction (D4) is transverse to the third direction (D3). The third angle (A3) is approximately 90 degrees; however, it should be appreciated that this third angle may vary in accordance with the present disclosure. The fourth angle (A4) is approximately 90 degrees; however, it should be appreciated that this fourth angle may vary in accordance with the present disclosure. In this example embodiment, the second distance (CBD2) is 3.65 mms); however, it should be appreciated that this distance may vary in accordance with the present disclosure.

The second strap engagement shoulder 310 includes a first section (not labeled) connected to the second end section 130 of the connecting bar 100, and a second section (not labeled) connected to the second strap engagement hand 330. The second strap engagement shoulder 310 and particularly these first and second sections thereof are formed with suitable lengths, at suitable angles, and with suitable curvatures as best shown in FIGS. 1 to 7 to position the second strap engagement hand 330 relative to the connecting bar 100 (and specifically at the designated angle relative to the connecting bar 100, the designated direction relative to the connecting bar 100, and the designated distance from the connecting bar 100). The second strap engagement shoulder 310 includes an inner surface 324 configured to engage, be engaged by, and/or contain the second side edges of the first section 810 and of the second or end section 830 of the webbing strap 800 as shown in FIGS. 8, 9, 10, and 11.

The second strap engagement hand 330 includes a first section (not labeled) connected to the second strap engagement shoulder 310 and a second section (not labeled) having a rounded free end 350. The second section of the second strap engagement hand 330 includes a portion of the upper surface that is flat. This flat portion 342 of the upper surface is configured to engage or be engaged by the second or end section 830 of the webbing strap 800 as shown in FIGS. 9 and 10. The second section of the second strap engagement hand 330 also includes a rounded lower surface 346 configured to engage, be engaged by, and/or contain the first section 810 of the webbing strap 800 as shown in FIGS. 8, 9, 10, and 11.

It should be appreciated that the second keeper bar can be otherwise suitably configured and sized in accordance with the present disclosure. It should further be appreciated that the second keeper bar can be formed from a tubular member instead of a solid member in accordance with the present disclosure. It should further be appreciated that more than one second keeper bar can be employed in the webbing strap trap in accordance with the present disclosure.

Likewise, the first retaining arm 400 includes a somewhat L-shaped partially cylindrical solid member having an upper surface 402, a first side surface 404, a lower surface 406, and a second side surface 408. More specifically, the first retaining arm 400 includes: (1) a third strap engagement shoulder 410 connected to and extends transversely outwardly in a fifth direction (D5) from and at a fifth angle (A5) from the first end section 110 of the connecting bar 100; and (2) a third strap engagement hand 430 connected to and extending transversely inwardly in a sixth direction (D6) from the third strap engagement shoulder 410, at a sixth angle (A6) from the third strap engagement shoulder 410, and at a third distance (CBD3) from the connecting bar 100. The fifth direction (D5) is transverse to the direction (not labeled) of the connecting bar 100. The sixth direction (D6) is transverse to the fifth direction (D2). The fifth angle (A5) is approximately 45 degrees; however, it should be appreciated that this fifth angle may vary in accordance with the present disclosure. The sixth angle (A6) is approximately 85 degrees; however, it should be appreciated that this sixth angle may vary in accordance with the present disclosure. In this example embodiment, the third distance (CBD3) is 3.65 mms; however, it should be appreciated that this distance may vary in accordance with the present disclosure.

The third strap engagement shoulder 410 includes a first section (not labeled) connected to the first end section 110 of the connecting bar 100, and a second section (not labeled) connected to the third strap engagement hand 430. The third strap engagement shoulder 410 and particularly these first and second sections thereof are formed with suitable lengths, at suitable angles, and with suitable curvatures as best shown in FIGS. 1 to 7 to position the third strap engagement hand 430 relative to the connecting bar 100 (and specifically at the designated angle relative to the connecting bar 100, the designated direction relative to the connecting bar 100, and the designated distance from the connecting bar 100). The third strap engagement shoulder 410 includes an inner surface 424 configured to engage, be engaged by, and/or contain the first side edges of the first section 810 and of the second or end section 830 of the webbing strap 800 as shown in FIGS. 8, 9, 10, and 11.

The third strap engagement hand 430 includes a first section (not labeled) connected to the third strap engagement shoulder 410 and a second section (not labeled) having a rounded free end 450. The second section of the third strap engagement hand 430 includes a rounded lower surface 446 configured to: (1) first engage, be engaged by, and/or contain the first section 810 of the webbing strap 800 as shown in FIGS. 8 and 11; and then (2) subsequently engage, be engaged by, and/or contain the second or end section 830 of the webbing strap 800 as shown in FIGS. 9 and 10.

Figure 4:
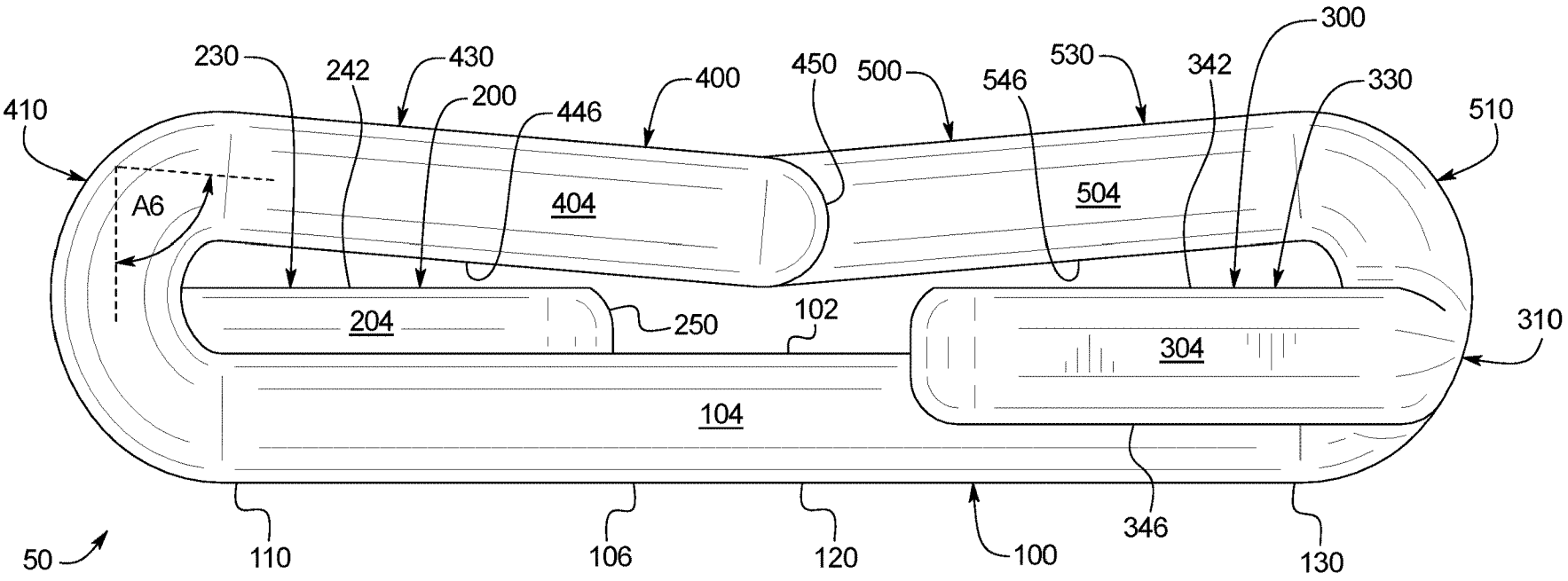
FIG. 4 is a first side view of the webbing strap trap of FIG. 1.
Figure 5:
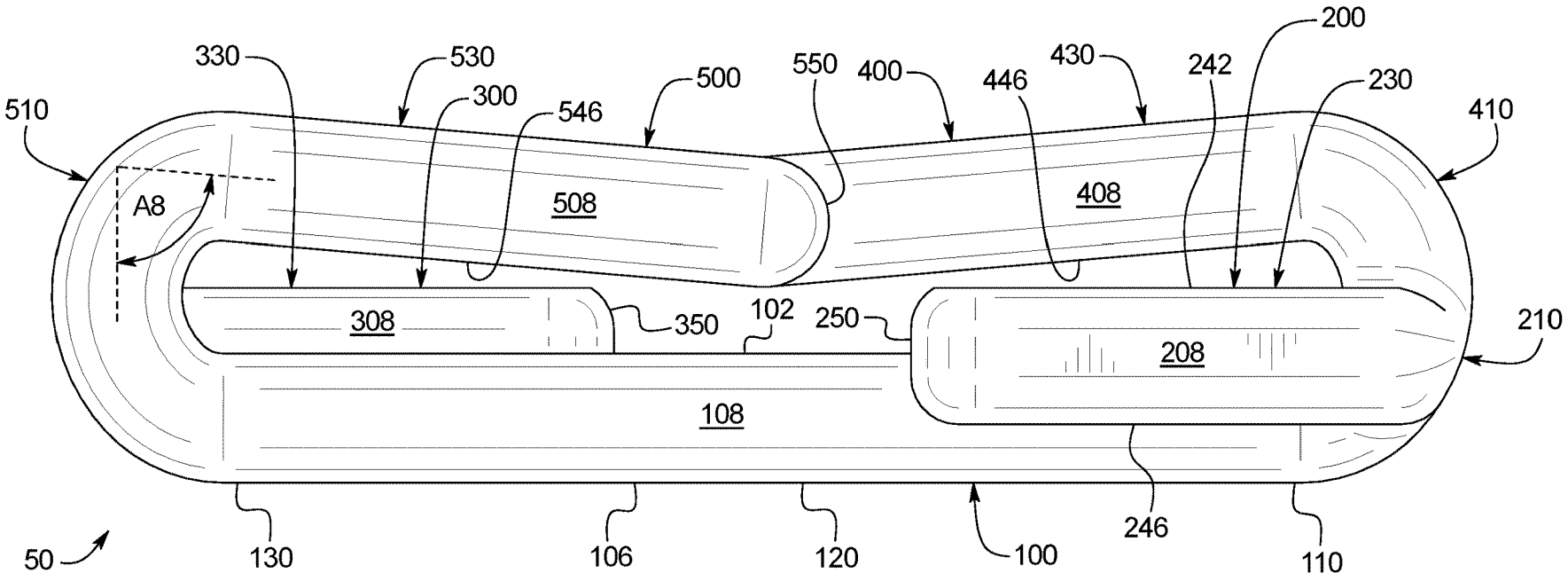
FIG. 5 is a second side view of the webbing strap trap of FIG. 1.
Figure 6:
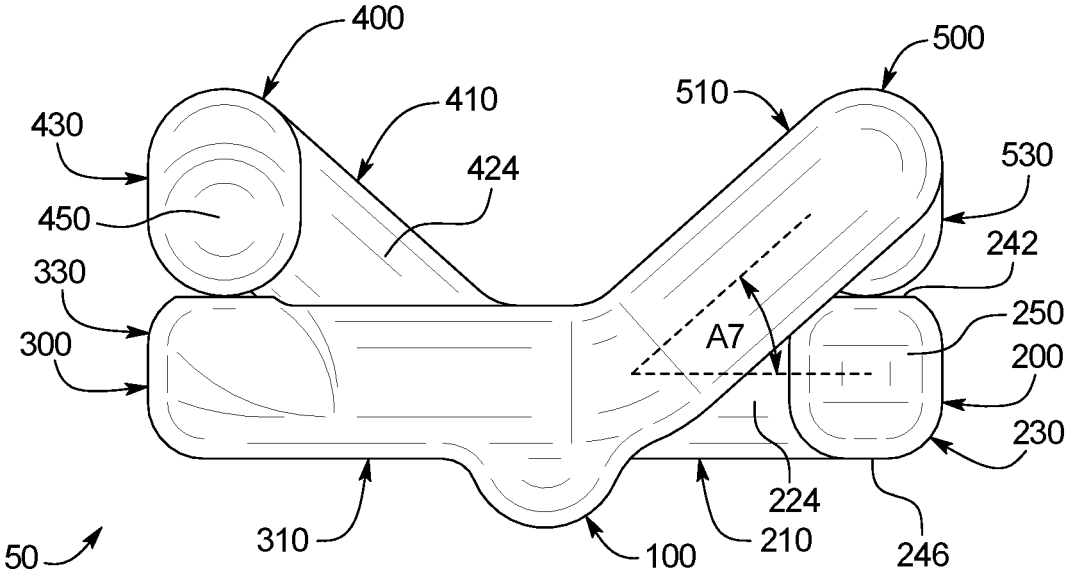
FIG. 6 is a first end view of the webbing strap trap of FIG. 1.
Figure 7:
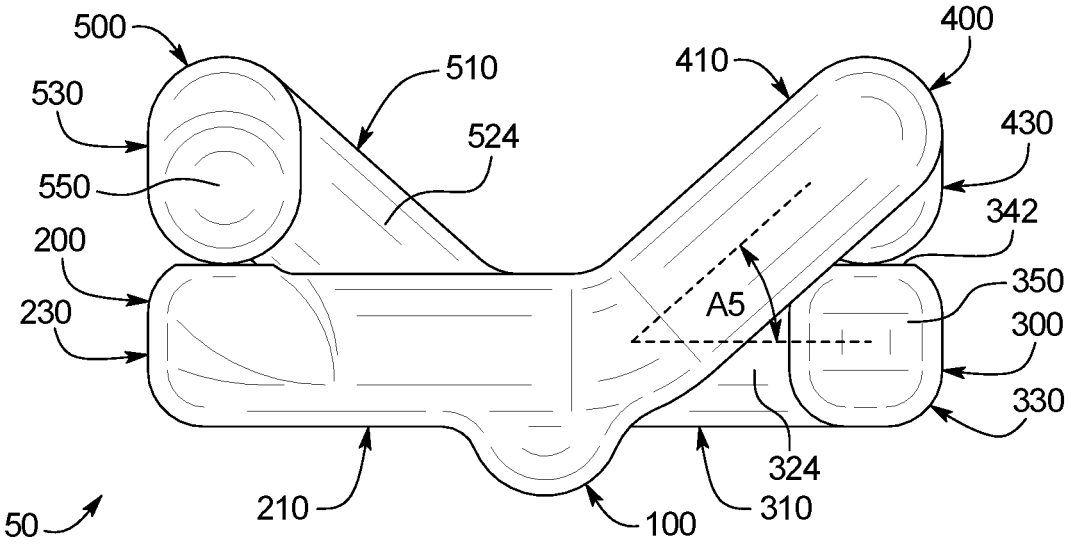
FIG. 7 is a second end side view of the webbing strap trap of FIG. 1.

The first retaining arm 400 and particularly the third strap engagement hand 430 thereof is angled slightly downwardly toward the connecting bar 100 (as best shown in FIGS. 4 and 5) and is of a suitable length such that it is configured to: (1) flex upwardly when the first section 810 of the webbing strap 800 and the second or end section 830 of the webbing strap 800 are positioned underneath the strap engagement hand 430, and (2) apply a suitable downward force on the first section 810 of the webbing strap 800 and the second or end section 830 of the webbing strap 800 when they are in position under the third strap engagement hand 430.

It should be appreciated that the first retaining arm can be otherwise suitably configured and sized in accordance with the present disclosure. It should further be appreciated that the first retaining arm can be formed from a tubular member instead of a solid member in accordance with the present disclosure. It should further be appreciated that more than one first retaining arms can be employed in the webbing strap trap in accordance with the present disclosure.

Likewise, the second retaining arm 500 includes a somewhat L-shaped partially cylindrical solid member having an upper surface 502, a first side surface 504, a lower surface 506, and a second side surface 508. More specifically, the second retaining arm 500 includes: (1) a fourth strap engagement shoulder 510 connected to and extending transversely outwardly in a seventh direction (D7) from and at a seventh angle (A7) to the second end section 130 of the connecting bar 100; and (2) a fourth strap engagement hand 530 connected to and extending transversely inwardly in an eight direction (D8) from the fourth strap engagement shoulder 510, at an eight angle (A8) to the fourth strap engagement shoulder 510, and at a fourth distance (CBD4) from the connecting bar 100. The seventh direction (D7) is transverse to the direction (not labeled) of the connecting bar 100. The eight direction (D8) is transverse to the seventh direction (D7). The seventh angle (A7) is approximately 45 degrees; however, it should be appreciated that this seventh angle may vary in accordance with the present disclosure. The eight angle (A8) is approximately 85 degrees; however, it should be appreciated that this eight angle may vary in accordance with the present disclosure. In this example embodiment, the fourth distance (CBD3) is 3.65 mms; however, it should be appreciated that this distance may vary in accordance with the present disclosure.

The fourth strap engagement shoulder 510 includes a first section (not labeled) connected to the second end section 130 of the connecting bar 100, and a second section (not labeled) connected to the fourth strap engagement hand 530. The fourth strap engagement shoulder 510 and particularly these first and second sections thereof are formed with suitable lengths, at suitable angles, and with suitable curvatures as best shown in FIGS. 1 to 7 to position the fourth strap engagement hand 530 relative to the connecting bar 100 (and specifically at the designated angle relative to the connecting bar 100, the designated direction relative to the connecting bar 100, and the designated distance from the connecting bar 100). The fourth strap engagement shoulder 510 includes an inner surface 524 configured to engage, be engaged by, and/or contain the second side edges of the first section 810 and of the second or end section 830 of the webbing strap 800 as shown in FIGS. 8, 9, 10, and 11.

The fourth strap engagement hand 530 includes a first section (not labeled) connected to the fourth strap engagement shoulder 410 and a second section (not labeled) having a rounded free end 550. The second section of the fourth strap engagement hand 530 includes a rounded lower surface 546 configured to: (1) first engage, be engaged by, and/or contain the first section 810 of the webbing strap 800 as shown in FIGS. 8 and 11; and then (2) subsequently engage, be engaged by, and/or contain the second or end section 830 of the webbing strap 800 as shown in FIGS. 9 and 10.

The second retaining arm 500 and particularly the fourth strap engagement hand 530 thereof is angled slightly downwardly toward the connecting bar 100 (as best shown in FIGS. 4 and 5) and is of a suitable length such that it is configured to: (1) flex upwardly when the first section 810 of the webbing strap 800 and the second or end section 830 of the webbing strap 800 are positioned underneath the fourth strap engagement hand 530, and (2) apply a suitable downward force on the first section 810 of the webbing strap 800 and the second or end section 830 of the webbing strap 800 when they are in position under the fourth strap engagement hand 530.

It should be appreciated that the second retaining arm can be otherwise suitably configured and sized in accordance with the present disclosure. It should further be appreciated that the second retaining arm can be formed from a tubular member instead of a solid member in accordance with the present disclosure. It should further be appreciated that more than second retaining arms can be employed in the webbing strap trap in accordance with the present disclosure.

In this illustrated example embodiment: (1) the bottom edge of the lower surface 106 of the connecting bar 100 lies in a first plane (P1); (2) the longitudinal central axis of the connecting bar 100 lies in a second plane (P2); (3) the top edge of the upper surface 102 of the connecting bar 100 lies in a third plane (P3); (4) the bottom edge of the lower surface 206 of the first strap engagement hand 230 of the first keeper bar 200 lies in a fourth plane (P4); (5) the longitudinal central axis of the first strap engagement hand 230 of the first keeper bar 200 lies in a fifth plane (P5); (6) the top edge of the upper surface 202 of the first strap engagement hand 230 of the first keeper bar 200 lies in a sixth plane (P6); (7) the bottom edge of the lower surface 306 of the second strap engagement hand 330 of the second keeper bar 300 lies in a seventh plane (P7); (8) the longitudinal central axis of the second strap engagement hand 330 of the second keeper bar 300 lies in an eight plane (P8); (9) the top edge of the upper surface 302 of the second strap engagement hand 330 of the second keeper bar 300 lies in a ninth plane (P9); (10) the bottom edge of the lower surface 406 of the third strap engagement hand 430 of the first retainer arm 400 lies in a tenth plane (P10); (11) the longitudinal central axis of the third strap engagement hand 430 of the first retainer arm 400 lies in an eleventh plane (P11); (12) the top edge of the upper surface 402 of the third strap engagement hand 430 of the first retainer arm 400 lies in a twelfth plane (P12); (13) the bottom edge of the lower surface 506 of the fourth strap engagement hand 530 of the second retainer arm 500 lies in a thirteenth plane (P13); (14) the longitudinal central axis of the fourth strap engagement hand 530 of the second retainer arm 500 lies in a fourteenth plane (P14); and (15) the top edge of the upper surface 502 of the fourth strap engagement hand 530 of the second retainer arm 500 lies in a fifteenth plane (P15). In this illustrated example embodiment of the strap trap 50 (when viewed from the sides or ends such as in FIGS. 4, 5, 6, and 7): (1) P1 is below P2 to P15; (2) P4 is above P1; (3) P6 is above P3; (4) P7 is above P1; (5) P9 is above P3; (6) P10 is above P3; (7) P10 is above P6; (8) P13 is above P3; and (9) P12 is above P9.

In this illustrated example embodiment, the connecting bar 100 has a first length (L1), the first hand 230 of the first keeper bar 200 has a second length (L2), the second hand 330 of the second keeper bar 300 has a third length (L3), the third hand 430 of the first retaining arm 400 has a fourth length (L4), and the fourth hand 230 of the second retaining arm 500 has a fifth length (L5). In this illustrated example embodiment: (1) L1>L2; (2) L1>L3; (3) L1>L4; (4) L1>L5; (5) L2=L3; (6) L4=L5; (7) L2<L4; (8) L2<L5; (9) L3<L4; (10) L3<L5; (11) L1>(L2+L4); and (12) L1>(L3+L5). In this illustrated example embodiment, the webbing strap trap 50 thus defines a first strap receiving gap 600 between the free end 250 of the first hand 230 of the first keeper bar 200 the free end 550 of the fourth hand 530 of the second retaining arm 500. Likewise, the webbing strap trap 50 thus defines a second strap receiving gap 650 between the free end 350 of the second hand 330 of the second keeper bar 300 and the free end 450 of the third hand 430 of the first retaining arm 400.

It should be appreciated that the relative sizes including these lengths and shapes of the connecting bar 100, the first keeper bar 200, the second keeper bar 300, the first retaining arm 400, and the second retaining arm 500 may vary in accordance with the present disclosure, and that the corresponding lengths and shapes of the first strap receiving gap 600 and the second strap receiving gap 650 may vary in accordance with the present disclosure. It should further be appreciated that in alternative embodiments of the present disclosure, (1) one or more of the above directions D1 to D8 may vary, (2) one or more of the planes P1 to P15 may vary, (3) one or more of the distances CBD1 TO CBD4 may vary, (4) one or more of the above angles A1 to A8 may vary, and/or (5) one or more of the lengths L1 to L5 may vary.

It should be appreciated from the above and from FIGS. 8, 9, 10 and 11, that the first strap receiving gap 600 and the second strap receiving gap 650 enable the first section 810 of the webbing strap 800 to be fully inserted in these gaps to mount the webbing strap trap 50 on the first section 810 of the webbing strap 800 as shown in FIGS. 8, 10, and 11. It should also be appreciated from the above and from FIGS. 8, 9, 10 and 11, that the first strap receiving gap 600 and the second strap receiving gap 650 also enable the second or end section 830 of the webbing strap 800 to be partially inserted in each of these gaps to mount the webbing strap trap 50 on the second or end section 830 of the webbing strap 800 as shown in FIGS. 9 and 10. After such attachment, the webbing strap trap 50 controls and limits movement of the excess second or end section 830 of the webbing strap 800 to prevent such excess end section 830 from flapping around and from catching on foreign objects.

Figure 12:
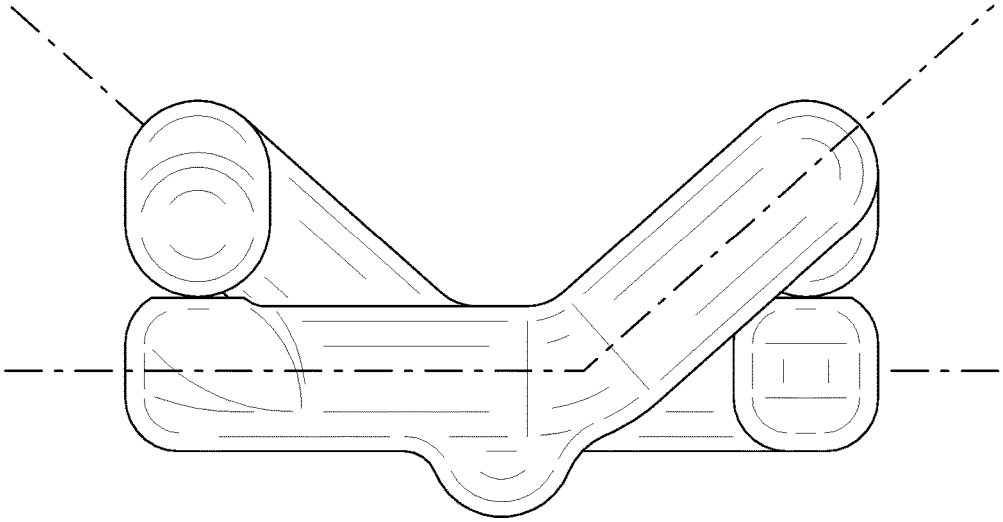
FIG. 12 is an end view of the webbing strap trap of FIG. 1 showing the different planes in dotted lines that extend from the connecting bar to each of the first keeper bar, the second keeper bar, the first retaining arm, and the second retaining arm.
Figure 13:
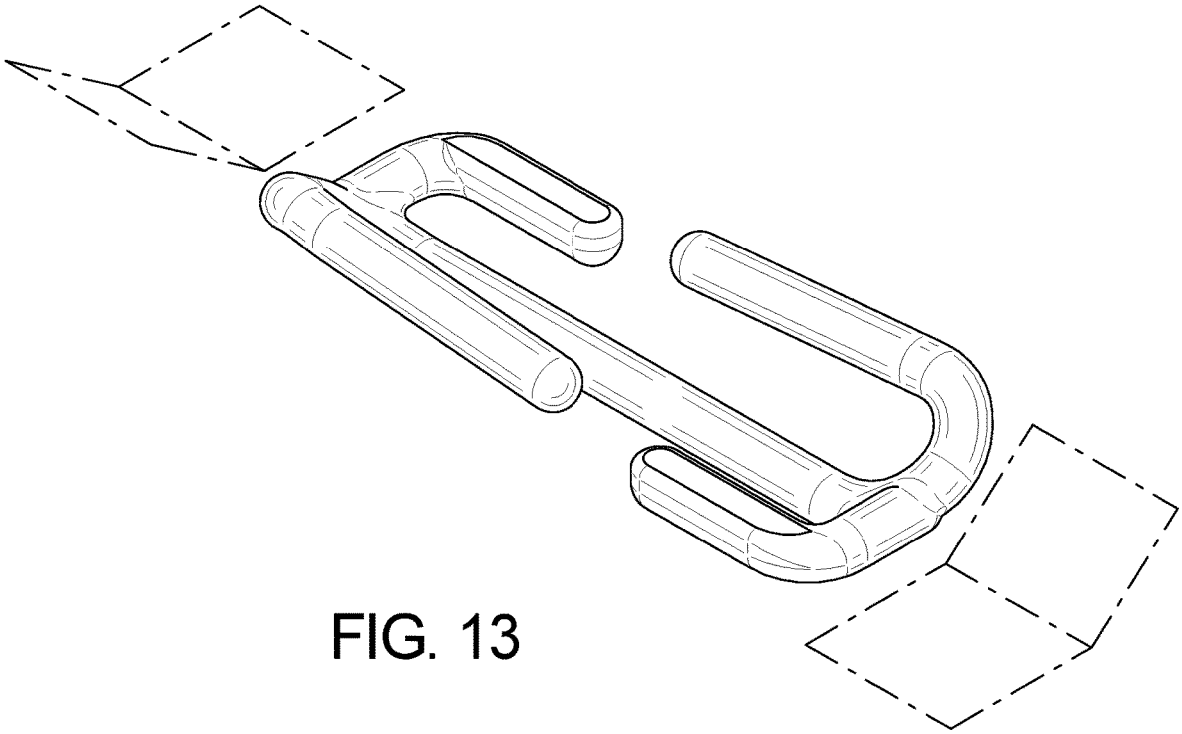
FIG. 13 is an top perspective view of the webbing strap trap of FIG. 1 showing the different planes in dotted lines that extend from the connecting bar to each of the first keeper bar, the second keeper bar, the first retaining arm, and the second retaining arm.

It should also be appreciated from the above and from FIGS. 12 and 13 show in dotted lines the different planes that extend from the connecting bar to each of the first keeper bar, the second keeper bar, the first retaining arm, and the second retaining arm.

Alternative embodiments of the present disclosure include a webbing strap with one or more web strapping traps as described herein attached to the webbing strap.

Alternative embodiments of the present disclosure include a product having one or more webbing straps with one or more web strapping traps as described herein attached to one or more of such webbing straps.

Various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A webbing strap trap comprising:

a connecting bar having a longitudinal axis and a center point along the longitudinal axis;

a first keeper bar connected to a first side of the connecting bar;

a second keeper bar connected to a second side of the connecting bar;

a first retaining arm connected to the first side of the connecting bar, the first retaining arm including a third strap engagement shoulder connected to and extending transversely outwardly and upwardly from the first end of the connecting bar and a third strap engagement hand connected to and extending transversely inwardly and downwardly from the third strap engagement shoulder; and a second retaining arm connected to the second side of the connecting bar, the second retaining arm including a fourth strap engagement shoulder connected to and extending transversely outwardly and upwardly from the second end section of the connecting bar and a fourth strap engagement hand connected to and extending transversely inwardly and downwardly from the fourth strap engagement shoulder, the first keeper bar and the second retaining arm defining a first strap receiving gap between the first keeper bar and the second retaining arm, and the second keeper bar and the first retaining arm defining a second strap receiving gap between the second keeper bar and the first retaining arm, wherein the first strap receiving gap is offset from the center point in a first direction and the second strap receiving gap is offset from the center point in an opposite second direction.

2. The webbing strap trap of claim 1, wherein the connecting bar, the first keeper bar, the second keeper bar, the first retaining arm, and the second retaining arm are monolithically formed from a rigid plastic material.

3. The webbing strap trap of claim 1, wherein the connecting bar has an upper surface configured to engage or be engaged by a rear surface of a first section of a webbing strap.

4. The webbing strap trap of claim 1, wherein the first keeper bar includes a first strap engagement shoulder connected to and extending transversely outwardly from a first end section of the connecting bar, and a first strap engagement hand connected to and extending transversely inwardly from the first strap engagement shoulder, wherein the first strap engagement hand is spaced apart a first distance from the connecting bar.

5. The webbing strap trap of claim 4, wherein the second keeper bar includes a second strap engagement shoulder connected to and extending transversely outwardly from a second end section of the connecting bar, and a second strap engagement hand connected to and extending transversely inwardly from the second strap engagement shoulder, wherein the second strap engagement hand is spaced apart a second distance from the connecting bar.

6. The webbing strap trap of claim 5, wherein the third strap engagement hand is spaced apart a third distance from the connecting bar.

7. The webbing strap trap of claim 6, wherein the fourth strap engagement hand is spaced apart a fourth distance from the connecting bar.

8. A webbing strap trap comprising:

a connecting bar having a first side and a second side, the first side facing in a different direction than the second side;

a first keeper bar connected to the connecting bar, the first keeper bar including a first strap engagement hand spaced apart a first distance from the first side of the connecting bar in a first plane;

a second keeper bar connected to the connecting bar, the second keeper bar including a second strap engagement hand spaced apart a second distance from the second side of the connecting bar in a second plane;

a first retaining arm connected to the connecting bar, the first retaining arm including a third strap engagement hand spaced apart a third distance from the first side of the connecting bar in a third plane; and a second retaining arm connected to the connecting bar, the second retaining arm including a fourth strap engagement hand spaced apart a fourth distance from the second side of the connecting bar in a fourth plane, wherein the third strap engagement hand extends a decreasing distance from the connecting bar and the fourth strap engagement hand extends a decreasing distance from the connecting bar.

9. The webbing strap trap of claim 8, wherein the connecting bar, the first keeper bar, the second keeper bar, the first retaining arm, and the second retaining arm are monolithically formed from a rigid plastic material.

10. The webbing strap trap of claim 8, wherein the third strap engagement hand is angled inwardly toward the connecting bar.

11. The webbing strap trap of claim 10, wherein the fourth strap engagement hand is angled inwardly toward the connecting bar.

12. The webbing strap trap of claim 8, wherein the first strap engagement hand and the fourth strap engagement hand define a first strap receiving gap, and the second strap engagement hand and the third strap engagement hand define a second strap receiving gap.

13. The webbing strap trap of claim 12, wherein the fourth strap engagement hand has a longer length than the first strap engagement hand, and the third strap engagement hand has a longer length than the second strap engagement hand.

14. The webbing strap trap of claim 8, wherein the fourth strap engagement hand has a longer length than the first strap engagement hand, and the third strap engagement hand has a longer length than the second strap engagement hand.

15. The webbing strap trap of claim 8, wherein the first strap engagement hand and the fourth strap engagement hand extend toward each other but are not directly connected to each other, and the second strap engagement hand and the third strap engagement hand extend toward each other but are not directly connected to each other.

16. A webbing strap trap comprising:

a connecting bar wherein a bottom edge of a lower surface of the connecting bar lies in a first plane, a longitudinal central axis of the connecting bar lies in a second plane, and a top edge of an upper surface of the connecting bar lies in a third plane;

a first keeper bar connected to the connecting bar, the first keeper bar including a first strap engagement shoulder connected to and extending transversely outwardly from a first end section of the connecting bar, and a first strap engagement hand connected to and extending transversely inwardly from the first strap engagement shoulder, wherein a bottom edge of a lower surface of the first strap engagement hand of the first keeper bar lies in a fourth plane, a longitudinal central axis of the first strap engagement hand of the first keeper bar lies in a fifth plane, and a top edge of an upper surface of the first strap engagement hand of the first keeper bar lies in a sixth plane;

a second keeper bar connected to the connecting bar, the second keeper bar including a second strap engagement shoulder connected to and extending transversely outwardly from a second end section of the connecting bar, and a second strap engagement hand connected to and extending transversely inwardly from the second strap engagement shoulder, wherein a bottom edge of a lower surface of the second strap engagement hand of the second keeper bar lies in a seventh plane, a longitudinal central axis of the second strap engagement hand of the second keeper bar lies in an eight plane, and a top edge of an upper surface of the second strap engagement hand of the second keeper bar lies in a ninth plane;

a first retaining arm connected to the connecting bar, the first retaining arm including a third strap engagement shoulder connected to and extending transversely outwardly from the first end of the connecting bar, and a third strap engagement hand connected to and extending transversely inwardly from the third strap engagement shoulder, the third strap engagement hand extending toward the first end section of the connecting bar, wherein a bottom edge of a lower surface of the third strap engagement hand of the first retaining arm lies in a tenth plane, a longitudinal central axis of the third strap engagement hand of the first retaining arm lies in an eleventh plane, and a top edge of an upper surface of the third strap engagement hand of the first retaining arm lies in a twelfth plane; and a second retaining arm connected to the connecting bar, the second retaining arm including a fourth strap engagement shoulder connected to and extending transversely outwardly from the second end section of the connecting bar, and a fourth strap engagement hand connected to and extending transversely inwardly from the fourth strap engagement shoulder, the fourth strap engagement hand extending toward the second end section of the connecting bar, wherein a bottom edge of a lower surface of the fourth strap engagement hand of the second retaining arm lies in a thirteenth plane, a longitudinal central axis of the fourth strap engagement hand of the second retaining arm lies in a fourteenth plane, and a top edge of an upper surface of the fourth strap engagement hand of the second retaining arm lies in a fifteenth plane, wherein the first plane is below each of the second planes to the fifteen plane, the sixth plane is above third plane, the ninth plane is above the third plane, the twelfth plane is above the sixth plane, and the fifteenth plane is above the ninth plane.

17. The webbing strap trap of claim 16, wherein the connecting bar, the first keeper bar, the second keeper bar, the first retaining arm, and the second retaining arm are monolithically formed from a rigid plastic material.

18. The webbing strap trap of claim 16, wherein the third strap engagement hand is angled inwardly toward the connecting bar, and the fourth strap engagement hand is angled inwardly toward the connecting bar.

* * * * *